United States Patent [19]

Hagimoto et al.

[11] Patent Number: 4,607,889

[45] Date of Patent: Aug. 26, 1986

[54] SHIELD TUNNEL BORING MACHINE

[75] Inventors: Hakumi Hagimoto; Yutaka Kashima; Norio Kondo; Masumi Inoue, all of Tokyo, Japan

[73] Assignee: Daiho Construction Co., Ltd., Tokyo, Japan

[21] Appl. No.: 676,063

[22] Filed: Nov. 29, 1984

[51] Int. Cl.[4] ..... F21D 9/08

[52] U.S. Cl. ..... 299/33; 299/11; 299/56; 175/62

[58] Field of Search ..... 299/55, 56, 58, 11, 299/33; 175/62, 65

[56] References Cited

U.S. PATENT DOCUMENTS

| | | | |
|---|---|---|---|
| 3,653,716 | 4/1972 | Hattrup | 175/62 X |
| 3,830,545 | 8/1974 | Snyden | 299/56 X |
| 4,298,230 | 11/1981 | Krabbe | 299/58 X |
| 4,406,498 | 9/1983 | Akesaka | 299/11 |

FOREIGN PATENT DOCUMENTS

| | | | |
|---|---|---|---|
| 3216742 | 12/1983 | Fed. Rep. of Germany | 175/65 |
| 2091316 | 7/1982 | United Kingdom | 175/65 |

*Primary Examiner*—Stephen J. Novosad
*Assistant Examiner*—Michael A. Goodwin
*Attorney, Agent, or Firm*—John H. Lynn

[57] ABSTRACT

A shield tunnel boring machine having at its boring head a pressure-resisting mud kneading chamber defined by a bulkhead, wherein the bulkhead is divided into outer peripheral and central bulkhead parts. The outer peripheral bulkhead part is fixed to the inner periphery of a cylindrical shield. The central bulkhead part is made rotatable in association with a head-positioned rotary cutter as driven by a main motor. The sealing means required for the bulkhead is limited to seal one for a gap between the fixed outer peripheral bulkhead part and the rotatable central bulkhead part and the number of necessary related parts can be remarkably reduced.

4 Claims, 6 Drawing Figures

SHIELD TUNNEL BORING MACHINE

BACKGROUND OF THE INVENTION

This invention relates to shield tunnel boring machines for excavating horizontal tunnels in unstable ground.

Generally, a machine of the type referred to is initially disposed within a pit in the earth made at the tunnel starting point and is then driven to excavate the ground in a horizontal direction in which the tunnel is to be bored, while a steel cylindrical shield effectively prevents the tunnel face ground layer from collapsing. For this reason, the machine should find its remarkable utility specifically when employed in boring a tunnel in the unstable ground of water-bushing, water-containing and highly fluidic ground layers.

DISCLOSURE OF PRIOR ART

Typically, a shield tunnel boring method using the machine comprising the cylindrical shield has been generally used in unstable ground layer, in which method the tunnel face ground is excavated while pressing the boring head of the shield against the ground and propelling the shield into the ground. The bored tunnel wall just behind the propelled shield is then reinforced with a plurality of tunnel wall segments or linings overlapped on the tail end of the shield. The horizontal tunnel can be formed in the soft and weak ground layer by sequentially performing such shield propelling and bored tunnel wall reinforcing tasks.

In this kind of the tunnel boring method, accidents such as a collapse of the tunnel face ground layer and underground water gushing into the interior of the shield from the tunnel face that the shield can sufficiently resist against ground or underground-water pressure of the tunnel face. In order to meet such requirements, there has been already suggested a so-called hydraulic boring method wherein a hydraulic chamber is defined in the head portion of the shield and a hydraulic pressure sufficient for bearing the tunnel face pressure is maintained in the chamber. With this known method, however, such hydraulic support is not totally reliable specifically when the tunnel face ground is unstable. The necessity of disposing of a quantity of mixture fluid of fed water or slurry and excavated ground formation has been a problem. Further, since the hydraulic pressure in the hydraulic chamber must be kept constant or varied quickly, the outlet required for the mixture fluid disposal from the chamber cannot be made larger in diameter.

Therefore, unless the entire hydraulic feed and discharge system becomes considerably complicated another problem to arises with respect to smooth discharge of large size gravels, stones and the like.

Further, the known hydraulic method cannot be properly utilized in a populated area because the mixture discharged in quantities in the fluid state requires large scale dehydrating equipment or a plant built on the ground surface for receiving and processing the fluid mixture. These building and removal costs become rather high, rendering the entire tunnelling cost and construction time to be considerably increased.

The present invention is based on another type of shield tunnel boring method which has eliminated the foregoing. This prior boring method shall be briefly described. In the prior method, the water-containing and fluidic ground layer at the tunnel face is excavated, in common with the aforementioned, with a rotating cutter within a frontward open and rearward closed kneading chamber at the head portion of the cylindrical shield, but the ground formation excavated and introduced into the chamber is mixed and kneaded with a suitable "muddying" material. The "muddying" material provides a proper viscosity and solidity to the fluidic formation. This properly solidified mud is easily conveyed through open atmospheric space in the tunnel and provides sufficient resistance to the ground pressure when the chamber is filled with the mud for stably supporting the unstable tunnel face ground and preventing it from collapsing. Without reducing the pressure in the chamber, the mud substantially corresponding in amount to the further excavated formation is discharged out of the chamber for easy conveyance to a suitable disposal place.

A material such as bentonite, carboxymethyl cellulose or the like which can provide a high viscosity to the watercontaining ground formation is used. As the "muddying" material. Mixing and kneading of the muddying material with the ground formation will render the resultant mud to still have a suitable plastic fluidity and water-impermeability that is sufficiently resistive against the tunnel face ground pressure for preventing even the underground water from flowing into the interior of the shield through the kneading chamber, regardless of the diameter of the tunnel. In this connection, the efficiency of the kneading action is an important factor for the sufficient resistivity.

A primary object of the present invention based on the aforementioned shield tunnel boring method of the "muddying" type is to provide a shield tunnel boring machine having a simple structural arrangement and high kneading efficiency. This object is accomplished by providing a rotary kneading means in the chamber outer peripheral and inner central portions of different speeds and in opposite directions.

Another object of the present invention is to provide a simplified and more durable shield tunnel boring machine thereby reducing maintenance work on the machine.

Still another object of the present invention is to provide a shield tunnel boring machine of a simpler structure, which is adapted to bore any larger diameter tunnel with the high kneading efficiency and is yet low in the manufacturing cost.

Other objects and advantages of the present invention shall become clear from the following description of the invention detailed with reference to preferred embodiments shown in the accompanying drawings.

In the following disclosure and appended claims:

The term "muddying" material shall mean a material in liquid or powdery state which is capable of imparting a proper viscosity, plastic fluidity and water-impermeability to the highly water-containing or highly fluidic ground formation when the material is mixed therewith, and is selected from materials such as bentonite, carboxymethyl cellulose, clay, fine sand and the like depending on the nature of the ground.

The term "plastic fluidity" shall mean a state showing a viscosity much higher than that of the water-containing ground formation, e.g., a deformably semi-set state of wet and kneaded clay, but still showing a suitable movability for sequential conveyance.

The term "water-impermeability" shall mean that the wtaer-permeability of the ground formation is reduced by the muddying material to the extent that the permeability is negligibly low due to a relatively high density close to that of the wet and kneaded clay.

The "mud" shall mean the viscous and plastically fluidic mixture of the "muddying" material and the water-containing ground formation, which provides a sufficient pressure for resisting ground or underground-water pressure exerted on the tunnel face, and yet is capable of being smoothly and conveyed as it is, while the original water content of the tunnel face ground is practically maintained.

Figure 1:
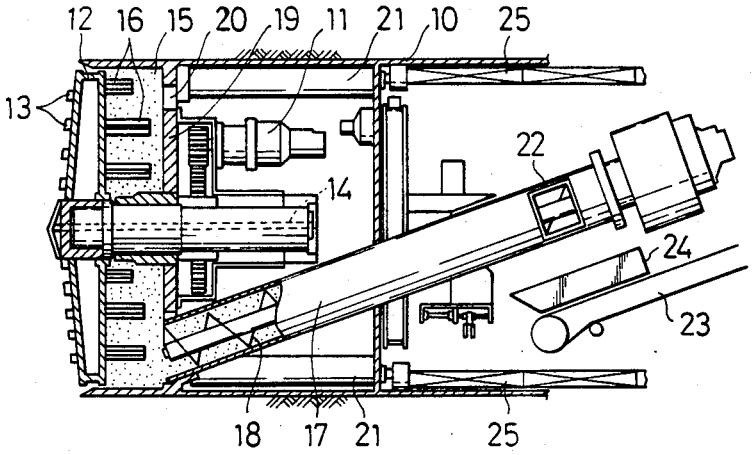
Fig. 1 (PRIOR ART)
FIG. 1 is a sectional view of a known basic shield tunnel boring machine adapted to perform the muddying type tunnel boring method.

While the present invention shall now be described with reference to the preferred embodiments shown in the drawings, it should be understood that the intention is not to limit the invention only to the particular embodiments shown but rather to cover all alterations, modifications and equivalent arrangements possible within the scope of the appended claims.

DISCLOSURE OF PREFERRED EMBODIMENT

Figure 2:
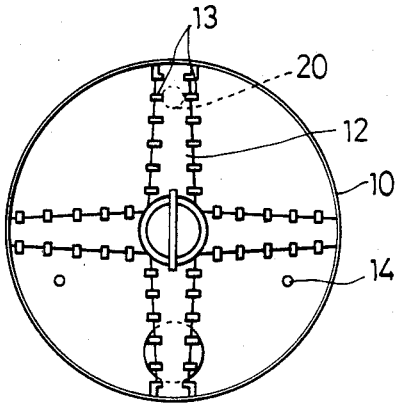
Fig. 2 (PRIOR ART)
FIG. 2 is a front view of the machine of FIG. 1.
Figure 3:
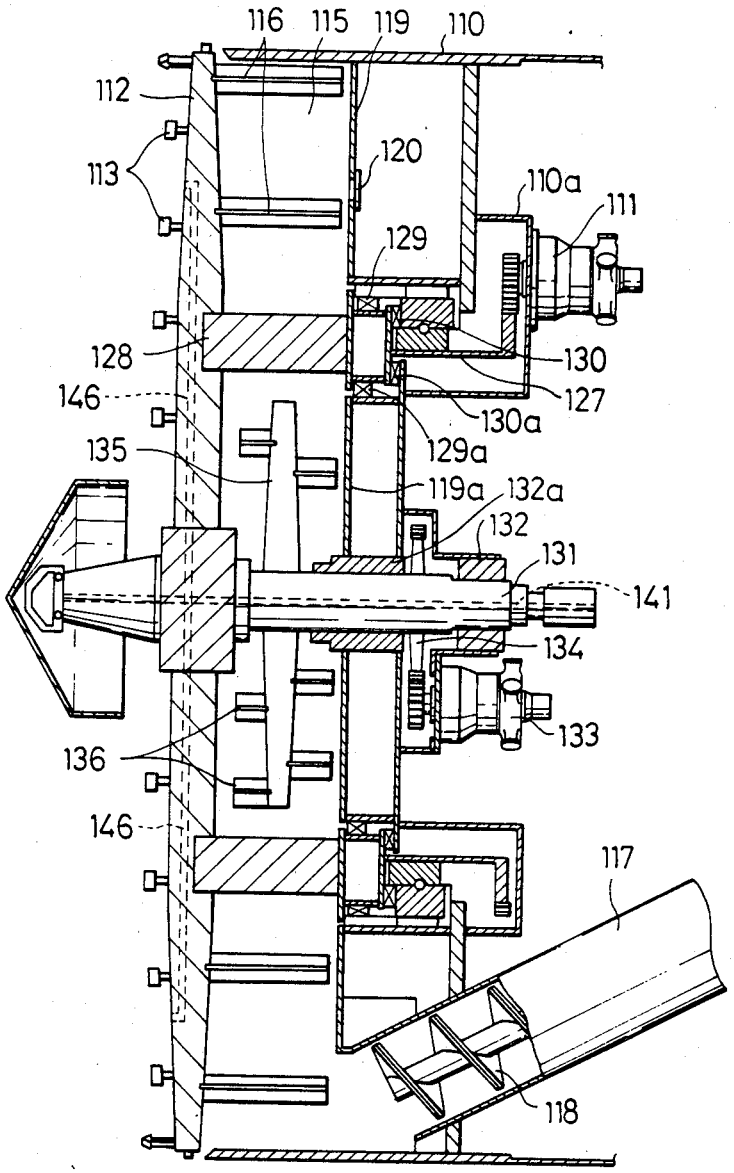
Fig. 3 (PRIOR ART)
FIG. 3 is a fragmental sectional view at the head portion of another shield tunnel boring machine previously suggested by the present inventors also for the muddying type tunnel boring, wherein a central kneading means is provided in the kneading chamber separately from an outer peripheral kneading means provided on the back of a rotary cutter at the front end of the chamber, the central and outer kneading means being rotatable independently of each other.

For better understanding of the present invention, reference shall be first made to the known basic shield tunnel boring machine of FIGS. 1 and 2 for the muddying type shield tunnel boring method, and then to the earlier suggested machine of FIG. 3 also for the same method and of an art closer to the present invention.

Referring to FIGS. 1 and 2, a cylindrical shield 10 to be propelled towards the tunnel face ground has a rotary cutter 12 positioned at the head end and rotated by an oil motor 11. A plurality of cutter bits 13 on the outer side of the cutter 12 rotate to hit and excavate the tunnel face ground of the horizontal tunnel. The muddying material is fed into a kneading chamber 15 through an injecting pipe 14 simultaneously with the cutter rotation by the motor 11. A plurality of kneading blades 16 extending rearward from the cutter and rotated therewith mix the muddying material with the ground formation excavated and introduced into the kneading chamber 15. The well kneaded mixture of the formation and muddying material will become a mud of the optimum viscosity, plastic fluidity and water-impermeability in the kneading chamber 15. The mud which fills the kneading chamber 15 as well as a conveyer cylinder 17 continuous to the chamber for conveying the mud therefrom attains sufficient pressure to resist the collapsing tunnel face ground pressure and gushing underground-water pressure. The resisting pressure is provided by a screw conveyer 18 within the conveyer cylinder 17. The mud pressure in the kneading chamber 15 is monitored by a pressure gauge 20 arranged in a bulkhead 19 defining the kneading chamber. When the mud pressure is insufficient for resisting the ground and underground-water pressures, the pressure gauge detects that the number of revolutions of the screw conveyer 18 in the conveyer cylinder 17 should be reduced, or that the propelling rate of shield propelling jacks 21 should be increased, so as to raise the withstanding pressure.

Further, the screw conveyer 18 is rotated so that the optimally viscous mud will be removed gradually from the kneading chamber 15 into the conveyer cylinder 17 and further to a discharging port 22 on the rear side of the shield, from which the mud is sequentially discharged onto a hopper 24 on a belt conveyer 23. Having been provided with the optimum viscosity, the discharged mud can be conveyed as it is, without any need of being dehydrated. Further, the pressure of the mud in the kneading chamber 15, which is open substantially over the entire front surface except for the cutter 12, is applied to the tunnel face to prevent its collapse and to resist the underground-water pressure. As the kneading chamber 15 and the conveyer cylinder 17 are filled with the water-impermeable mud without any clearance, the underground water will be positively prevented from flowing into the shield 10. Under this condition, the shield 10 is propelled forward by the jacks 21 to gradually extend the horizontal tunnel while supporting and reinforcing the bored tunnel wall surface by means of segments 25 assembled sequentially as preliminarily overlapped on the tail end of the shield 10.

With the arrangement of FIGS. 1 and 2, satisfactory results can be obtained when the tunnel to be excavated is of a relatively small diameter. When the tunnel is of a larger diameter and thus the shield is correspondingly larger in the diameter, on the other hand, there arises a problem. The similarly increased diameter of the rotary cutter 12 carrying the kneading blades will cause the existing difference in the circumferential rotating speed of the blades at different radial positions to be remarkable between the central portion and the outer peripheral portion of the kneading chamber. Such a remarkable difference in the kneading speed results in an inhomogeneous state of the mud in the kneading chamber. In order to remove this problem, there has been suggested another arrangement such as shown in FIG. 3, wherein the kneading blades positioned in the radially central portion of the rotary cutter can rotate independently of the blades in the radially outer peripheral portion.

Referring to FIG. 3, this tunnel boring machine has substantially the same arrangement as that in FIGS. 1 and 2, except for certain structural changes necessitated by the increase in the diameter of the cylindrical shield. Accordingly, FIG. 3 shows only the head part of an increased diameter shield 110, wherein constituent members having the same functions as those in FIGS. 1 and 2 are denoted by the same reference numerals but increased by 100. In the machine, the bulkhead defining a kneading chamber 115 comprises an outer peripheral bulkhead part 119 and a central bulkhead part 119*a*. A mounting frame 110*a* secured inside the shield 110 behind the bulkhead is provided on the rearward side with a main motor 111 for driving a rotary cutter 112. The rotary output of motor 111 is transmitted through an output gear of the motor to a cylindrical power coupler 127 which is connected operatively through rotary supports 128 to the rotary cutter 112 for its rotation. In addition to forward projected bits 113, the rotary cutter 112 carries kneading blades 116 extending rearward only in the outer peripheral zone in the kneading chamber 115.

On the other hand, a rotary shaft 131 is rotatably supported in the center of the shield 110 by means of bearings 132 and 132*a* at the rearward and intermediate positions. The output of a submotor 133 is transmitted through a gear 134 to the shaft 131 so that the shaft 131 can rotate independently of the rotary cutter 112, while the forward end of the shaft 131 is rotatably supported at the center of the cutter 112. The rotary shaft 131 carries kneading wings 135 which can rotate in the central zone of the kneading chamber 115. Each wing 135 has on its front and back sides auxiliary kneading blades 136 projecting in the axial direction of the chamber. With such arrangement, the submotor 133 can rotate at a higher speed than the main motor 111 so as to increase the kneading force in the central zone of the kneading chamber and thus to achieve an improved kneading efficiency in the entire chamber.

With the above arrangement of FIG. 3, uniform kneading force can be realized in the kneading chamber 115. The arrangement, however, requires that the divided bulkhead parts 119 and 119*a* which are both fixed to the shield 110 must be provided with many sealing members 129, 130 and 129*a*, 130*a* at both radial sides and rearward end of the respective rotary supports 128. These supports are passed through the bulkhead for rotation between the two stationary bulkhead parts 119 and 119*a*, so as to prevent any invasion of mud or water into the shield 110. If, in this case, the sealing of the sealing members is incomplete, the safety of workers inside the shield cannot be sufficiently secured The sealing members must be manufactured with considerably high accuracy to provide a high sealing property. Since such sealing members wear out in a short period, it is necessary to conduct frequent maintenance works for their exchange at a proper cycle. For these reasons, it has been demanded that the number of the sealing members requiring the high accuracy be reduced to simplify the arrangement, to ease and simplify the manufacture and maintenance of the boring machine.

According to the present invention, there is provided a shield tunnel boring machine which is remarkably easy and simple to manufacture and maintain, without deteriorating the uniform and effective kneading action achieved within the kneading chamber.

Figure 4:
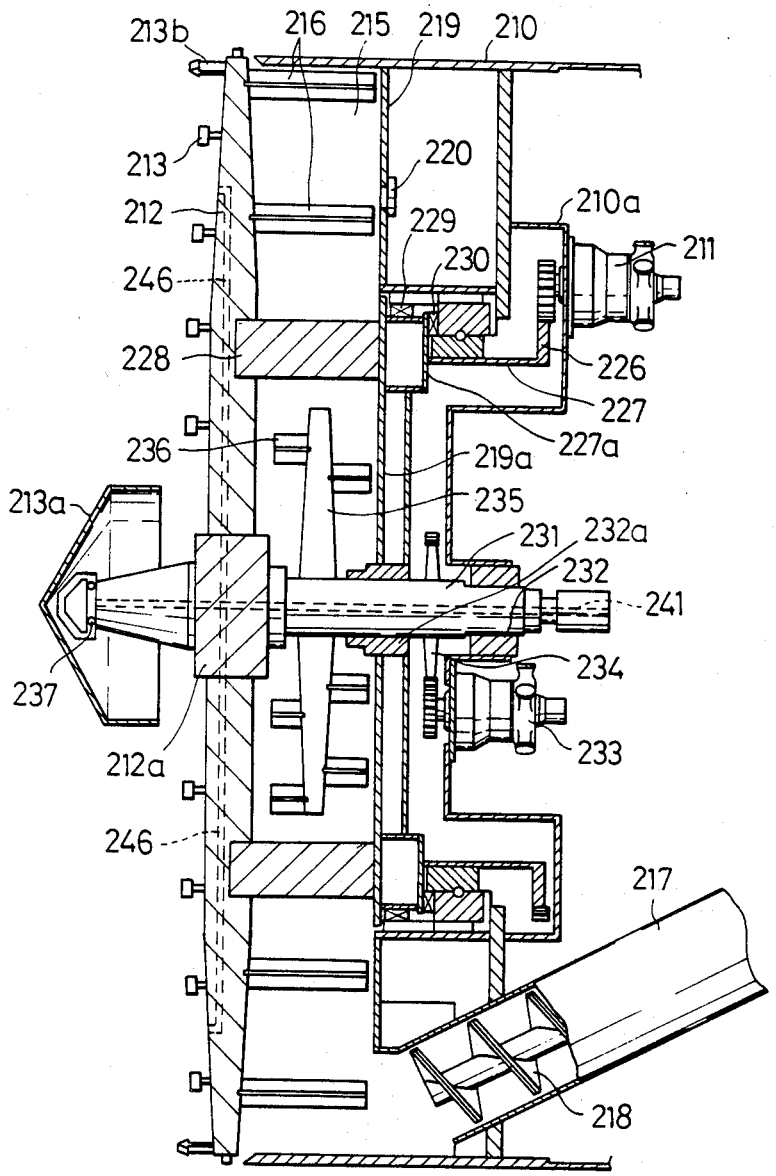
FIG. 4 is a similar fragmental sectional view of an embodiment of a shield tunnel boring machine according to the present invention.

Referring to FIG. 4, there is shown a shield tunnel boring machine in an embodiment according to the present invention, wherein members having the same functions as those in FIGS. 1 and 2 are denoted by the same reference numerals but increased by 200. In the machine of this embodiment, the bulkhead of a cylindrical shield 210 for defining therein a kneading chamber 215 is also divided into two parts comprising an outer peripheral bulkhead part 219 and a central bulkhead part 219*a*. As a feature of the present invention, the central bulkhead part 219*a* is made rotatable in contrast to the foregoing arrangement, while the outer peripheral bulkhead part 219 is made stationary as fixed to the shield 210. More specifically, a mounting frame 210*a* defining a substantially U-shaped space in section is secured to the shield to cover the rear side of the central bulkhead part 219*a*. A main motor 211 for driving a front rotary cutter 212 through a peripheral gear 226 of a cylindrical coupler 227 is mounted to the frame 210*a* at the upper part of the rear end wall. The cylindrical coupler 227 is coupled preferably at its forward end through a frame member 227*a to the rear face of the central bulkhead part 219a* near its peripheral edge. To the front face of edge the rotary cutter 212 is coupled through rotary supports 228 which extend in the axial direction of the shield within the kneading chamber 215. A single sealing member 229 is disposed between the stationary outer peripheral bulkhead part 219 and the rotary central bulkhead part 219*a*. A further single sealing member 230 is disposed between the fixed mounting frame 210*a* and the frame member 227*a* rotatable with the central bulkhead part 219*a*.

Further, a rotary shaft 231 is rotatably supported in the center of the frame 210*a* and central bulkhead part 219*a* by means of bearings 232 and 232*a* respectively provided between the shaft and the frame 210*a* and between the shaft and the rotary central bulkhead part 219*a*. The forward end of the shaft 231 is rotatably supported by a boss 212*a* in the center of the rotary cutter 212. Fixedly mounted on the rotary shaft 231 at a position behind the bulkhead part 219*a* and within the frame 210*a* is a gear 234. The gear 234 meshes with an output gear of a submotor 233 secured to the rear side of the frame 210*a* adjacent its center where the rear end of the rotary shaft 231 is born, so that the shaft 231 can be rotated by the submotor 233 independently of the cutter 212 which is rotated by the main motor 211. In this case, the submotor 233 may be made to drive the shaft 231 in a direction opposite to the rotation of the cutter 212 driven by the main motor 211. Fixedly mounted to the rotary shaft 231 are central kneading wings 235 extending radially within the central zone of the kneading chamber 215. Each wing 235 is provided at its front and back faces with auxiliary kneading blades 236 projecting in the axial direction of the shield. A muddying material supply pipe 241 is contained in the rotary shaft 231, as shown by dotted lines, so as to supply the muddying material through an outlet 237 provided in a central cutter bit 213*a* of the rotary cutter 212 to an area in front of the central kneading wings 235. The supply pipe 241 communicates with further supply pipes 246 extending inside the rotary cutter 212, so as to supply the muddying material to a circumferential area in front of the outer peripheral zone of the kneading chamber 215. In kneading chamber 215 the peripheral kneading blades 216 of the cutter 212 extend rearward, while the cutter 212 has many cutting bits 213 radially along the cutter and peripheral cutting bits 213*a*.

With this arrangement actuation of, the main motor 211 actuated causes the cylindrical coupler 227, central bulkhead part 219*a*, rotary supports 228 and rotary cutter 212 to be rotated about the axis of the shield 210. At the same time, the actuated submotor 233 rotates the rotary shaft 231 and kneading wing 235. When the rotating rate of the submotor 233 is increased and, as required, its rotating direction is made opposite to that of the main motor 211, the peripheral kneading blades 216 and central kneading blades 236 will achieve the same satisfactory kneading effect within the kneading chamber as in the case of the smaller diameter boring machine of FIG. 3. In the present instance, on the other hand, the central bulkhead part 219*a* is rotated together with the rotary cutter 212, and the requirement of sealing can be limited to only a single gap between the stationary and rotary bulkhead parts 219 and 219*a* and the mounting frame 210*a*. In the mounting of frame 210*a* only two sealing members 229 and 230 may be provided, so that the number of necessary sealing members can be reduced to half that in the case of FIG. 3.

Figure 5:
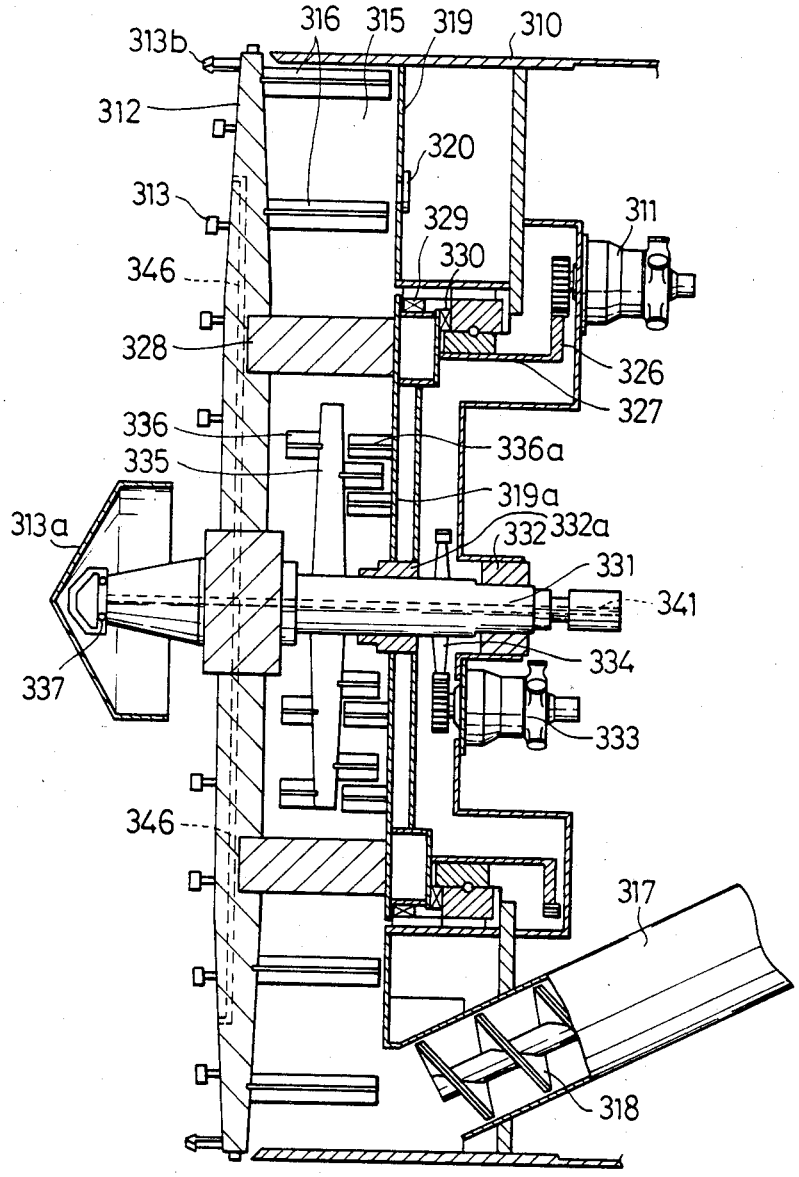
FIGS. 5 and 6 show respectively in similar manner to FIG. 4 further embodiments of the shield tunnel boring machine according to the present invention.

In FIG. 5, there is shown a shield tunnel boring machine in another embodiment of the present invention, wherein the same constituent members as those in the embodiment of FIG. 4 are denoted by the same reference numerals but increased by 100. The only difference between this embodiment and that of FIG. 4 is that additional kneading blades 336*a* are provided to extend forward from the central bulkhead part 319*a* and are positioned in alternate relation to the rearward kneading blades 336 of the kneading wing 335 secured to the axial rotary shaft 331. The other members are arranged in the same manner as in FIG. 4. With this arrangement, the submotor 333 is driven in the opposite direction to the main motor 311 cause the blades 336 and 336a to rotate in directions opposite to each other. Thus, a satisfactory kneading effect can be obtained within the kneading chamber 315, even when the rotational speed of the submotor 333 is so selected as not to be higher than that of the main motor 311.

According to a further feature of the present invention, interlocking rotation of the central bulkhead part with the rotary cutter. the muddying-material feeding pipe can be effectively linearized to prevent any clogging in the pipe. That is, in the earlier suggested device of FIG. 3 and the foregoing machines of the present invention as in FIGS. 4 and 5 as well, the muddying-material supply pipe 141, 241 or 341 extending axially through the rotary shaft is coupled at the rearward end through a rotary joint to a material feeding means disposed behind the shaft and at the forward end to the outlet in the central cutter bit. The further supply pipes 146, 236 or 346 are provided in the rotary cutter to extend in its radial direction while coupled at the inner end to the pipe in the rotary shaft and opened at the outer end in front of the peripheral kneading blades. Accordingly, the muddying material supplied through the pipes 146, 236 or 346 in the rotary shaft to the outer peripheral zone in the kneading chamber is forced to flow as turned substantially at right angles with respect to the pipe 141, 241 or 341 in the rotary shaft. As a result, there arises a risk of clogging at the right angled coupling between the pipes. This clogging can almost never be removed during the operation of the tunnel boring in which the high pressure of the mud resisting the tunnel face ground pressure is maintained in the kneading chamber. For this reason, it is intended to remove such and to render the supply pipes to be cleanable while improving the supplying effect, so that the desired effective kneading action can be achieved in combination with the improved kneading effect.

Figure 6:
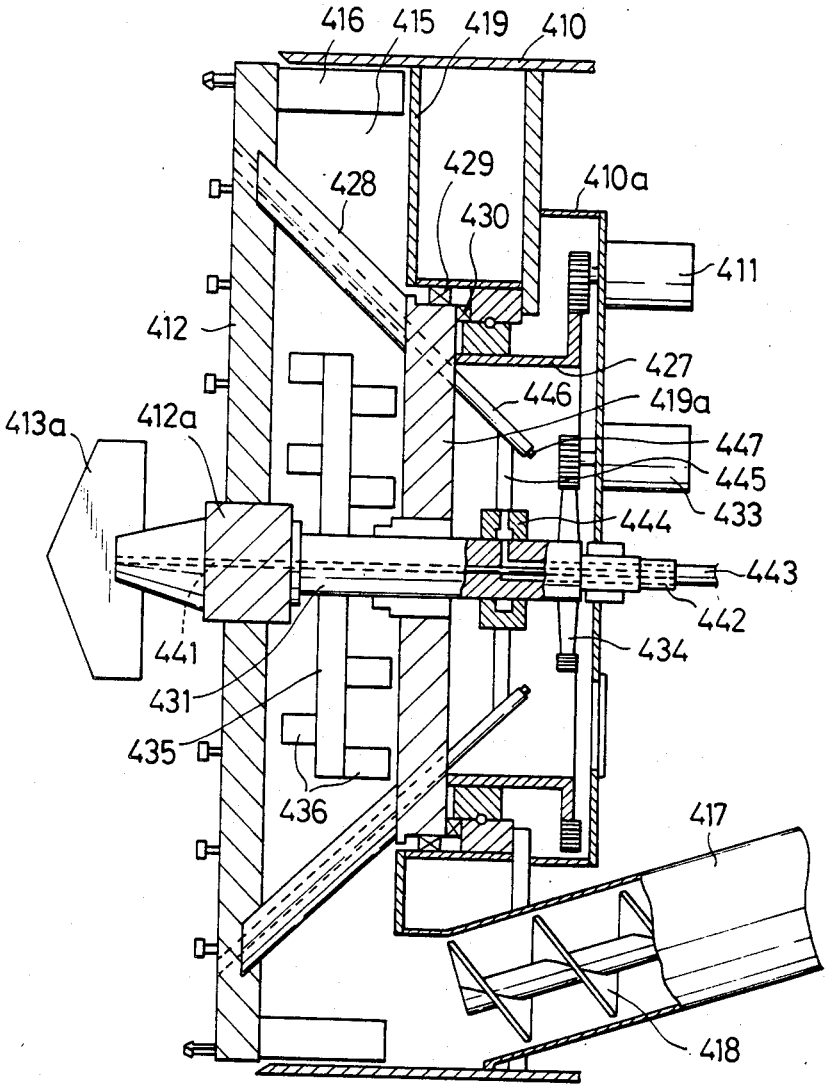

In FIG. 6, there is shown a further embodiment suggested for removing the risk of the clogging, in which respective members achieving the same functions as those in the embodiment of FIG. 4 are denoted by the same reference numerals as in FIG. 4 but increased by 200. In the present instance, the muddying-material supply pipe 441 provided in the rotary shaft 431 is connected at the rearward end through a rotary joint 442 to a material feeding pipe 443 coupled to the same end of the shaft 431 and at the other forward end through the center boss 443 to the central cutter bit 413*a* where the pipe is opened, as in the case of FIG. 4. This pipe 441 is made partly to communicate with a distributor 444 mounted rotatably about the shaft 431 on the rear side of the central bulkhead part 419*a*. The distributor 444 is coupled through radially extending pipes 445 to linear diagonal pipes 446 adjacent their rearward ends. These pipes 446 extend diagonally outward through the outer peripheral part of the central bulkhead part 419*a* and kneading chamber 415 to the outer peripheral parts of the rotary cutter 412 to open at the forward ends in front of the outer peripheral zone of the kneading chamber. These linear diagonal pipes 446 have plugs 447 at the rearward ends so that the interior of there pipes can be cleaned with the plugs 447 removed whenever required. If necessary, further, the distributor 444 may even be disassembled for the cleaning because it is disposed behind the bulkhead. In order to render the linear diagonal pipes 446 to be sufficiently durable, specifically, at their part disposed in the kneading chamber, it is preferable that such rotary supports extended between the rotary central bulkhead part and the rotary cutter as in the embodiment of FIG. 4 are inclined outward from the central bulkhead part 419*a* to the outer peripheral part of the rotary cutter 412, and that the linear diagonal pipes 446 are passed longitudinally through these rotary supports 428.

The embodiment of FIG. 6 utilizes the arrangement in which the central bulkhead part 419*a* is rotatable with the rotary cutter 412 so that the muddying material supply path to the outer peripheral parts of the cutter is linearized for preventing the path from being clogged or for allowing the path to be easily cleaned if it should become clogged. Other arrangements of other constituent members and their functions in this embodiment are substantially the same as those in the case of FIG. 4.

What is claimed as our invention is:

1. A shield tunnel boring machine for boring a tunnel in the earth, comprising:

a cylindrical shield having a longitudinal axis;

a bulkhead in said shield for defining a forward open chamber at a forward end of said shield, said bulkhead comprising an outer peripheral bulkhead part fixed to said shield and a central bulkhead part rotatable about the longitudinal axis of said shield;

a main motor secured inside said shield for rotating said central bulkhead part;

a rotary cutter coupled through a rotary support to said central bulkhead part, said rotary cutter being in front of said forward open chamber to bear against a tunnel face for excavating earth therefrom;

a plurality of forward projecting cutter bits extending from a front face of said rotary cutter;

a plurality of kneading blades extending rearwardly from a rear face of said rotary cutter into said outer peripheral part of said forward open chamber parallel to the longitudinal axis of said shield;

a rotary shaft supported rotatably along the longitudinal axis of said shield independently of said rotary cutter;

a submotor secured inside said shield for rotating said rotary shaft;

a kneading wing fixedly mounted on said rotary shaft and extending radially from said rotary shaft in a central zone of said chamber, said kneading wing having a front face and a back face;

a plurality of auxiliary kneading blades extending from the front and back faces of said kneading wing parallel to the longitudinal axis of said shield;

means disposed between the fixed outer peripheral bulkhead part and the rotatable central bulkhead part for forming a seal therebetween;

means for supplying a muddying material to a forward side of said chamber, said muddying material being mixed and kneaded by said kneading wing and blades with the excavated earth in said chamber to render excavated water-containing earth introduced into the chamber to be a mud having a viscosity that provides resistance to ground pressure and to underground water pressure at the tunnel face while being conveyable from said chamber; and means contiguous to said chamber for discharging said mud out of said chamber.

2. A machine according to claim 1, further comprising:

a mounting frame fixed to said shield behind said bulkhead for rotatably supporting said central bulkhead part and said rotary shaft, said central bulkhead part having a rearward face, said mounting frame having a face opposing said central bulkhead rearward face; and a sealing member between said central bulkhead rearward face and said opposing face of said mounting frame.

3. A machine according to claim 1, wherein said central bulkhead part has a front face with a plurality of forward extending kneading blades fixed thereto at positions to extend into said chamber.

4. A shield tunnel boring machine for boring a tunnel in the earth, comprising:

a cylindrical shield having a longitudinal axis;

a bulkhead in said shield for defining a forward open chamber at a forward end of said shield, said bulkhead comprising an outer peripheral bulkhead part fixed to said shield and a central bulkhead part rotatable about the longitudinal axis of said shield;

a rotary cutter coupled through a rotary support to said central bulkhead part, said rotary cutter being in front of said forward open chamber to bear against a tunnel face for excavating earth therefrom, said rotary cutter having a front face and a rear face;

a plurality of forward projecting cutter bits extending from said front face of said rotary cutter;

a plurality of kneading blades extending rearwardly from said rear face of said rotary cutter in an outer peripheral part of said chamber;

a rotary shaft supported rotatably along the longitudinal axis of said shield;

a kneading wing fixedly mounted on said rotary shaft and extending radially from said rotary shaft in a central zone of said chamber, said kneading wing having a front face and a back face;

a plurality of auxiliary kneading blades extending from the front and back faces of said kneading wing parallel to the longitudinal axis of said shield;

means secured inside said shield for rotating said central bulkhead part and said rotary shaft independently of one another;

means disposed between the fixed outer peripheral bulkhead part and the rotatable central bulkhead part for forming a seal therebetween;

a first muddying material supply path extending axially through said rotary shaft from a rear end thereof;

material feeding means connected to a forward end of said rotary shaft and having an opening in a central portion of said rotary cutter;

a second muddying material supply path communicating with said first muddying material supply path, said second muddying material supply path including a distributor disposed behind said central bulkhead part and extending linearly through said central bulkhead part and said chamber to an outer peripheral portion of said rotary cutter and having an opening on a front side of said outer peripheral bulkhead portion, said muddying material being mixed and kneaded by said kneading wing and blades with the excavated earth in said chamber to render excavated water-containing earth introduced into the chamber to be a mud having a viscosity that provides resistance to ground pressure and to underground water pressure at the tunnel face while being conveyable from said chamber; and means contiguous to said chamber for discharging said mud out of said chamber.

* * * * *